United States Patent [19]

Cesari et al.

[11] Patent Number: 4,986,962

[45] Date of Patent: Jan. 22, 1991

[54] INHIBITORS OF CORROSION IN HIGH-STRENGTH AND MEDIUM-STRENGTH STEELS

[75] Inventors: Marco Cesari; Arnaldo Roggero; Luigi Rivola, all of San Donato Milanese; Yean Demertzis, Milan, all of Italy

[73] Assignee: Eniricerche, S.p.A., Milan, Italy

[21] Appl. No.: 380,981

[22] Filed: Jul. 17, 1989

[30] Foreign Application Priority Data

Jul. 29, 1988 [IT] Italy ..... 21552 A/88
Dec. 23, 1988 [IT] Italy ..... 23094 A/88

[51] Int. Cl.[5] ..... C23F 11/00

[52] U.S. Cl. ..... 422/7; 422/16; 422/14

[58] Field of Search ..... 422/7, 14, 16; 564/275, 564/278

[56] References Cited

U.S. PATENT DOCUMENTS

| | | | |
|---|---|---|---|
| 2,496,596 | 2/1950 | Moyer et al. | 422/7 |
| 2,643,977 | 6/1953 | Hughes | 422/7 |
| 2,836,558 | 5/1958 | Hughes | 422/7 |
| 3,025,313 | 3/1962 | Gunderson | 422/7 |
| 3,247,094 | 4/1966 | Dajani | 422/7 |
| 3,432,527 | 3/1969 | Malec et al. | 422/7 |

*Primary Examiner*—Robert J. Warden
*Assistant Examiner*—Laura E. Collins
*Attorney, Agent, or Firm*—Hedman, Gibson, Costigan & Hoare

[57] ABSTRACT

A method is disclosed for the inhibition of general corrosion, and of stress corrosion by hydrogen sulfide in manganese and low-alloy, medium-strength and high strength steels, obtained by means of the use of compounds of formula:

$$R_1—CH=N—[-(CH_2)_n—N=CH—]_m—R_2 \quad (I)$$

4 Claims, No Drawings

INHIBITORS OF CORROSION IN HIGH-STRENGTH AND MEDIUM-STRENGTH STEELS

The present invention relates to a method for inhibiting the corrosion in manganese and low-alloy, medium-strength and high-strength steels.

Corrosion, due to its nature of process of decay of metal materials used for building structures and production facilities, causes enormous direct and indirect damages.

In particular, the corrosion of steels commonly used in petrochemical industry, besides in the facilities for production, extraction and transport of gas and petroleum represents a serious problem, because the normal corrosive action of water and oxygen is potentiated and speeded up by the presence of carbon dioxide, as well as of organic and inorganic salts and acids.

Stress corrosion in the presence of hydrogen sulfide (SSC), frequently observed in petroleum extraction facilities, is particularly serious. Furthermore, it is known that in buried metal structures colonies of sulfate-reducing bacteria may develop under anaerobial conditions, with the relevant production of hydrogen sulfide.

The resulting embrittlement (besides the general corrosion) in these steels, which simultaneously undergo mechanical stresses of considerably high value, results often in cracking and microcracking of the material, and is the cause of serious risks of failure and of mechanical collapse.

Although a large number of inhibitors of general corrosion are known, no evidence exists of effective inhibitors of stress corrosion caused by hydrogen sulfide in high-strength or medium-strength, manganese and low-alloy steels. These steel types are largely used for building structures undergoing such severe stresses that and the use of inhibitors would offer an improvement in the margins of safety in the calculation of the structures, as well as a considerable reduction in costs.

The present Applicant has now surprisingly found that some azomethynes exert an effective protective action towards the general corrosion and the embrittlement caused by hydrogen sulfide (SSC) in high-strength or medium-strength steels of P-110 and X-70 type.

In accordance therewith, the present invention relates to a method for inhibiting the general corrosion and the stress embrittlement caused by hydrogen sulfide (SSC), both in the presence and in the absence of $CO_2$, of manganese and low-alloy steels having different mechanical strength, used in the systems for drilling, producing, transporting and processing gas and petroleum, characterized in that an organic substance selected from among the group consisting of those substances as defined by the general formula:

$$R_1—CH=N—[—(CH_2)_n—N=CH—]_m—R_2 \quad (I)$$

wherein:

$R_1$ and $R_2$, which may be equal to, or different from, each other, are a straight or branched, saturated or unsaturated, either substituted or non-substituted hydrocarbon chain of from 1 to 30 carbon atoms, or a one-ring or condensed two-ring aromatic or heteroaromatic radical;

m is either 0 or 1; and n is a numeral comprised within the range of from 1 to 30, is added to the aggressive aqueous-organic mixture into contact with said systems.

In the present invention, by "compounds defined by the formula (I)", both the substance in pure form, and a mixture of such compounds, whether monomeric or polymeric, contained in the reaction mixture, are meant.

For the purposes of the present invention, a preferred group of compounds of formula (I) comprises those compounds in which $R_1$ and $R_2$, the one independently from the other one, represent an aliphatic radical with an either straight or branched chain, containing from 1 to 30 carbon atoms, and, possibly, one or more unsaturations, or a one-ring or condensed two-ring hetero-aromatic radical.

A more preferred group comprises those compounds of formula (I) in which $R_1$ and $R_2$, the one independently from the other one, represent an aliphatic radical with an either straight or branched chain, containing from 1 to 30 carbon atoms, or a condensed two-ring hetero-aromatic radical.

The compounds of formula (I) are prepared according to methods known from classic chemistry for the preparation of the Schiff bases. Said compounds are typically prepared by means of the condensation of an aldehyde with an amine.

When m is 0, the substances can be prepared by means of the condensation of an aldehyde of formula (II):

$$R_1—CHO \quad (II).$$

with an amine of formula $$H_2N—R_2.$$

When m is 1, the substances can be prepared by means of the condensation of an amine of formula $$H_2N—(CH_2)_n—NH_2$$

with at least one aldehyde of formula (II).

$R_1$, $R_2$ and n are as hereinabove defined for the general formula (I).

In practice, the reaction is carried out according to traditional methods, by causing the two starting compounds to react with each other in the presence of an inert, high-boiling organic solvent.

In order to be used as corrosion inhibitors, such compounds, or the mixture of said compounds of both monomeric and polymeric character, contained in the reaction mixture, are generally added, in an amount comprised within the range of from 1 to 500 ppm, to the aqueous-organic mixture into contact with the steel structures.

Such an amount will be preferably comprised within the range of from 5 to 200 ppm, and still more preferably it will be comprised within the range of from 15 to 100 ppm.

The temperature of usage of the compounds according to the present invention is not critic, and very good results were obtained within the temperature range of from 0° to 180° C.

The following examples which are given for the only purpose of better illustrating some representative aspects of the present invention should not be interpreted as being limitative of the scope of the same invention.

EXAMPLES 1-10

The compounds of the Examples from 1 to 10, whose structure is reported in Table I, were prepared according to the general method as herein reported in the following:

The amine of formula $H_2N—R_2$ (0.10 eq) for the Examples from 1 to 4, and the amine of formula $H_2N—(CH_2)_n—NH_2$ for the Examples from 5 to 10, is charged to a three-necked flask (of 250 ml of capacity), equipped with thermometer, magnetic stirring means, and with the adaptor for a dripping funnel and a distiller.

The amine is then diluted with toluene (100 ml). To this solution, maintained with stirring, a solution (100 ml) containing a stoichiometric amount of the aldehyde $R_1—CHO$ in toluene is added dropwise.

The reaction mixture is then heated until toluene is completely distilled off; then the vacuum of a water vacuum pump is applied, the reaction mixture is progressively heated up to a temperature of 250°-300° C., and is finally maintained 2 hours at this maximum temperature value.

The I.R. analysis of the so obtained products confirmed the assigned structures.

TABLE 1

$R_1—CH=N—[—(CH_2)_n—N=CH—]_m—R_2$

| Example No. | $R_1$ | $R_2$ | m | n |
|---|---|---|---|---|
| 1 | $CH_3$ | $CH_3—(CH_2)_7—$ | 0 | — |
| 2 | $CH_3$ | $CH_3—(CH_2)_{11}—$ | 0 | — |
| 3 | $CH_3—(CH_2)_2—$ | $CH_3—(CH_2)_7—$ | 0 | — |
| 4 | $CH_3—(CH_2)_{11}—$ | 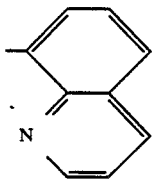 | 0 | — |
| 5 | $CH_3—(CH_2)_2—$ | $CH_3—CH_2—$ | 1 | 3 |
| 6 | $CH_3—(CH_2)_2—$ | $CH_3—CH_2—$ | 1 | 6 |
| 7 | $CH_3—(CH_2)_9—$ | $CH_3—(CH_2)_9—$ | 1 | 3 |
| 8 | $CH_3—(CH_2)_9—$ | $CH_3—(CH_2)_9—$ | 1 | 4 |
| 9 | $CH_3—(CH_2)_9—$ | $CH_3—(CH_2)_9—$ | 1 | 12 |
| 10 | $CH_3—(CH_2)_3—$ | $CH_3—(CH_2)_3—$ | 1 | 8 |

EXAMPLES 11-20

In order to evaluate the effect of corrosion inhibition, the corrosion currents and the hydrogen permeation currents were measured on specimens in the absence and in the presence of inhibitors.

More particularly, specimens of API 5L X70 steel of blade shape with 1 mm of thickness are dipped into standard aqueous solutions containing acetic acid (0.5%) and sodium chloride (5%) saturated with hydrogen sulfide, and not containing any inhibitors (Example 11), or containing 25 ppm of a compound according to the Examples from 1 to 9 (respectively Examples from 12 to 20).

The results are reported in the following Table.

TABLE 2

| Example No. | Compound of Example No. | $I_{corr}$, $\mu A/cm^2$ | $I_{perm}$, $\mu A/cm^2$ |
|---|---|---|---|
| 11 | — | 372.3 | 6.9 |
| 12 | 1 | 4.2 | 0.88 |
| 13 | 2 | 6.2 | 0.16 |
| 14 | 3 | 4.2 | 1.08 |
| 15 | 4 | 5.0 | 0.25 |
| 16 | 5 | 3.2 | 0.74 |
| 17 | 6 | 3.4 | 0.75 |
| 18 | 7 | 10.0 | 2.7 |
| 19 | 8 | 4.28 | 2.45 |
| 20 | 9 | 4.8 | 0.92 |

The decrease in the corrosion rate and in the permeation current, with the consequent decrease in hydrogen concentration inside the steel, confirm the effect of inhibition of the general corrosion performed by the compounds according to the instant invention.

EXAMPLE 21

In order to evaluate the effect of inhibition of the stress corrosion by hydrogen sulfide, a corrosion test was developed according to the standards described in NACE Standard TM/01/77 on specimens of medium-high strength steel.

In particular, specimens of API 5L X70 steel, prepared according to the Standard Test TM/01/77, are put under stress under constant load equal to 95% of yielding strength inside standard aqueous solutions containing acetic acid (0.5%) and sodium chloride (5%), saturated with hydrogen sulfide; one of said solutions does not contain any inhibitors, whilst the other solutions contain 25 ppm of each one of the compounds of Examples from 1 to 9.

Whilst in the solution not containing inhibitors, after about 10 hours the fracture occurs of the tested specimen, in the other solutions, containing the compounds of Examples from 1 to 9 as the inhibitors, after 720 hours no fractures were observed.

EXAMPLE 22

The standard corrosion test according to the standards as described in NACE Standard TM/01/77 was furthermore carried out according to the same method as reported in Example 21 on specimens of API 5L X52 steel. In this case too, in the solutions containing 25 ppm of the compounds of Examples from 1 to 9, no fractures occur after 720 hours.

EXAMPLE 23

The test of stress corrosion by hydrogen sulfide of Example 21 is furthermore carried out at 80° C. instead than at the standard temperature of 25° C., on specimens of API 5L X70 steel submitted to stress under constant load, inside solutions containing 25 ppm of the compounds of Examples 1 and 2 as the inhibitors.

Also in this case, after 720 hours, no fractures are observed.

EXAMPLE 24

The corrosion inhibiting effect of the compound of Example 10 having the formula $C_4H_9—CH=N—(CH_2)_8—N=CH—C_4H_9$ is evaluated according to the method disclosed in Example 11–20, but using solutions containing variable amounts of such a compound. The results obtained are reported in following Table III:

TABLE III

| ppm | $I_{corr}$, $\mu A/cm^2$ | $I_{perm}$, $\mu A/cm^2$ |
|---|---|---|
| 10 | 5.9 | 0.66 |
| 25 | 3.6 | 0.83 |
| 50 | 3.8 | 0.25 |
| 100 | 10.6 | 0.41 |

The effect of inhibition of stress corrosion by hydrogen sulfide of the compound of formula $$C_4H_9—CH=N—(CH_2)_8—N=CH—C_4H_9$$

is evaluated on the contrary by means of the standard test disclosed in Example 21, using a solution containing 25 ppm of the compound under test.

After 720 hours, no failures are observed.

We claim:

1. Method for inhibiting the general corrosion and the stress embrittlement caused by hydrogen sulfide (SSC), both in the presence and absence of $CO_2$, of manganese and low-alloy steels having different values of mechanical strength, which are used in systems for drilling, producing, transporting and processing gas and petroleum, employing an aqueous-organic mixture comprising selecting compounds from the group consisting of the formula:

$$R_1—CH=N—[—(CH_2)_n—N=CH—]_m—R_2 \quad (I)$$

wherein:

$R_1$ and $R_2$, may be equal to, or different from each other and are straight, saturated, non-substituted hydrocarbon chains of from 1 to 30 carbon atoms, or a two-ring aromatic radical;

m is either 0 or 1; and n is a numeral comprising the range of from 1 to 30, and adding said compound to the aqueous-organic mixture into contact with said system.

2. The method of claim 1 in which the compounds of formula (I) are added in an amount within the range of from 1 to 500 ppm.

3. The method of claim 2 in which said amount is added in the range of from 5 to 200 ppm.

4. The method of claim 3 in which said amount is added in the range of from 15 to 100 ppm.

* * * * *